United States Patent [19]

Rickard

[11] Patent Number: 4,494,468

[45] Date of Patent: Jan. 22, 1985

[54] STEAM GENERATOR WITH GAS RECIRCULATION TO THE ASH HOPPER REGION OF THE FURNACE

[75] Inventor: Earl K. Rickard, East Granby, Conn.

[73] Assignee: Combustion Engineering, Inc., Windsor, Conn.

[21] Appl. No.: 565,090

[22] Filed: Dec. 23, 1983

[51] Int. Cl.[3] ..... F23B 7/00

[52] U.S. Cl. ..... 110/234; 110/171; 110/204; 122/479 A

[58] Field of Search ..... 110/234, 204, 171, 165 R; 122/479 A

[56] References Cited

U.S. PATENT DOCUMENTS

| | | | |
|---|---|---|---|
| 3,155,074 | 11/1964 | Clayton | 122/479 A |
| 4,286,548 | 9/1981 | Brash | 110/204 X |
| 4,359,949 | 11/1982 | Moore | 110/171 |

*Primary Examiner*—Edward G. Favors

*Attorney, Agent, or Firm*—Robert L. Olson

[57] ABSTRACT

A steam generating unit using gas recirculation (28) for steam temperature control, where the recirculated gases are introduced (38) into the furnace (12) through the bottom opening (34) through which the ash is discharged. Dampers (40) are positioned in the gas recirculation duct (28) for controlling flow therethrough.

1 Claim, 1 Drawing Figure

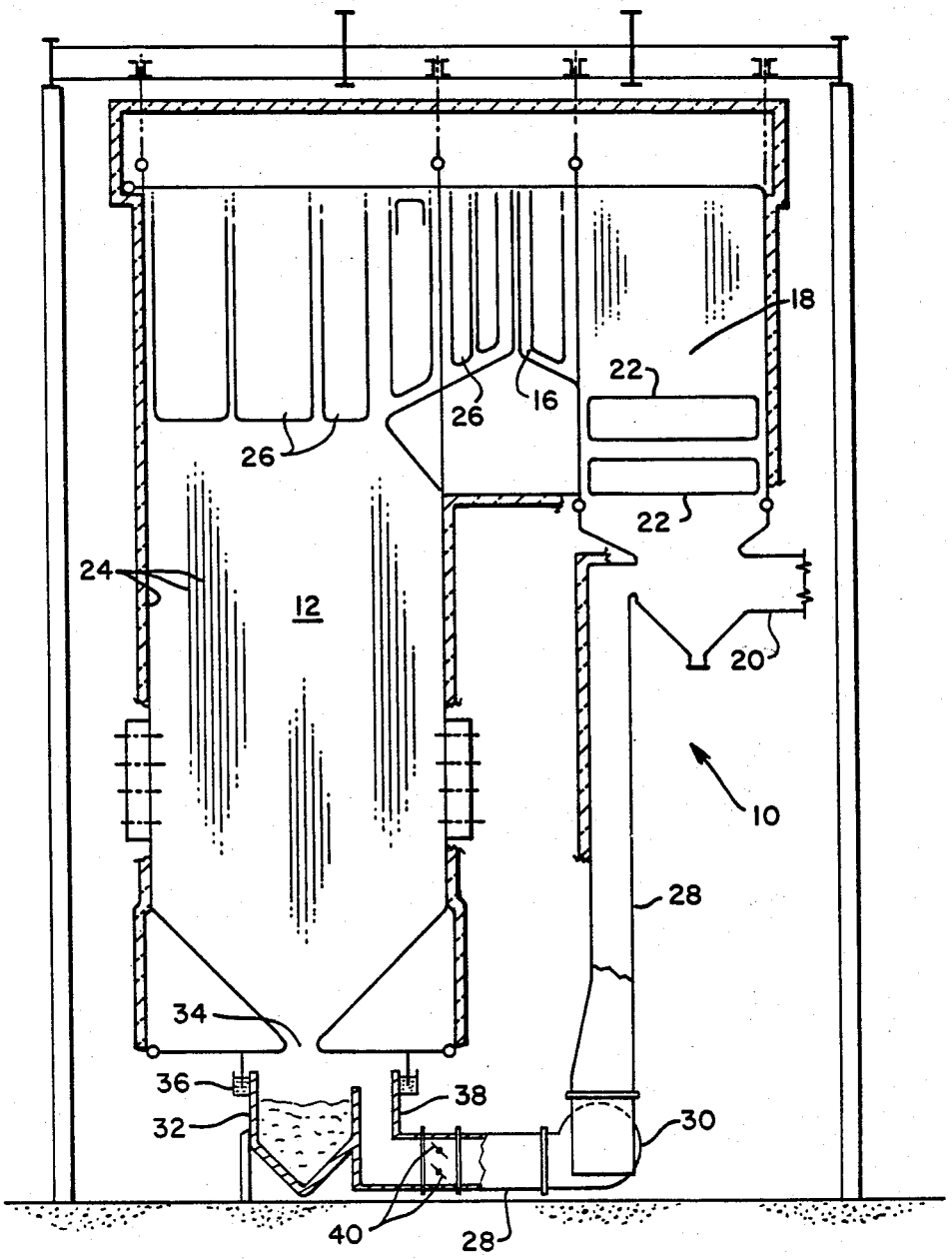
18
22
26
16
26
22
24
12
20
10
28
34
36
38
32
30
40
28

STEAM GENERATOR WITH GAS RECIRCULATION TO THE ASH HOPPER REGION OF THE FURNACE

BACKGROUND OF THE INVENTION

One manner of controlling steam temperature with varying load conditions of a steam generator is to recirculate gases from the rear gas pass of a furnace back to the furnace. In order to maintain superheat temperature constant regardless of what load the unit is operating at, the recirculation of gases back to the furnace is increased as the load increases. One typical gas recirculation arrangement in use today introduces gas through the furnace wall at a point some distance from the furnace bottom. This has the following disadvantages. Since furnaces are generally lined with welded walls formed of welded together steam generating tubes, the openings are expensive to form. Also, the lower the introduction of the gases into the furnace, the more effective it is in preventing heat transfer to the furnace walls.

Another arrangement in use today, which overcomes the above problems, introduces the recirculated gas through the ash discharge opening in the furnace bottom. This arrangement is typified by U.S. Pat. No. 3,580,226 which issued on May 25, 1971. As mentioned, this patent overcomes the above problems. However, this patent makes use of a liquid valve in the gas recirculation line. The use of the liquid valve places a tortuous path in this line, thus increasing the pressure drop, and thus also the horsepower requirements considerably. This could increase the cost of the unit by more than $100,000.

Another arrangement in use today which overcomes the liquid valve problem is shown in U.S. Pat. No. 2,985,152, which issued on May 23, 1961, where the recirculated gases are introduced into the ash hopper located below the furnace. This arrangement has the disadvantage of increasing the overall height of the unit. Since large steam generators are supported from the top by structural steel, it is desirable to keep the height of a unit to a minimum. An arrangement such as shown in U.S. Pat. No. 2,985,152 could increase the overall height by 4 feet or more, resulting in increased costs of $50,000 to $100,000.

SUMMARY OF THE INVENTION

In the gas recirculation system of this invention, recirculated gases are introduced into the furnace through the bottom opening through which the ash is discharged. Dampers are positioned in the gas recirculation duct for controlling flow therethrough.

BRIEF DESCRIPTION OF THE DRAWINGS

The FIGURE is a sectional side view of the furnace of a steam generator incorporating the gas recirculation arrangement of the present invention.

DESCRIPTION OF THE PREFERRED EMBODIMENT

Looking now to the drawing, 10 is a steam generating unit having a furnace 12. Fuel is introduced into the furnace and burned therein by burners 14. The hot combustion gases rise and exit from the furnace through horizontal gas pass 16 and rear pass 18 before being exhausted to the atmosphere through duct 20 which is connected to a stack, not shown.

Steam is generated and heated by flowing through the various heat exchangers located in the unit. Water is heated in economizer 22 and then flows through the water tubes 24 lining the furnace walls, where steam is generated. From here the steam passes through the superheater sections 26 and thereafter goes to a turbine, not shown.

When the turbine is used for driving a generator for producing electricity, it is necessary to maintain the superheat temperature constant regardless of what load the unit is operating at. The superheat temperature in most units tends to decrease with decrease in load. To overcome this problem, relatively cool combustion gases are recirculated back to the furnace in an increasing amount as the load decreases. This decreases the amount of heat transferred to the radiant steam generating surface 24 lining the furnace walls while increasing the amount of heat transferred to the convection superheat surfaces located outside of the furnace, thus holding the superheat temperature substantially constant even though the load on the unit decreases.

Gases are recirculated back to the furnace through duct 28. A fan is provided in the duct to provide for flow of gases when desired. The outlet of duct 28 is positioned inside of a liquid seal 36. From here the gases flow upwardly through the throat opening 34 into the furnace proper. Dampers 40 control the flow of the recirculated gases. These dampers are in their opened position when gases are recirculated, and are closed when no gases are being recirculated. The dampers keep fan 30 from being exposed to high temperature gas within the furnace when no gas recirculation is taking place.

Most large steam generators are top supported so that they are free to contract and expand due to temperature changes of the structure. The ash hopper 32 is bottom-supported. Since hot gases must be prevented from entering the boiler room through the ash hopper, a liquid seal 36 is provided between the furnace 12 and the ash hopper. This allows relative movement between the furnace and ash hopper while preventing escape of the hot combustion gases therefrom.

The outlet end 38 of the gas recirculation duct, by being attached to the wall of the ash hopper 32, can introduce recirculated gases into the furnace without requiring any of the furnace wall tubes from being bent. It also does not require the overall furnace to be of any greater height than it would be if there were no provision whatsoever for gas recirculation. There is no tortuous path in the gas recirculation duct, which would increase pressure drop and horsepower requirements, as would be the case if a liquid valve were used.

I claim:

1. In a steam generating unit having a furance and heat exchange means for generating steam therein, an ash hopper located beneath the furnace, said furnace having opening means connecting the ash hopper to the furnace, water-filled trough means surrounding the ash hopper, wall means extending down from the furnace into the trough means, which terminates below the water level so as to form a liquid seal for preventing hot combustion gases from escaping therefrom, duct means, said duct means having an inlet end connected to the steam generating unit downstream of the heat exchange means, and an outlet end positioned inside the liquid seal but below the furnace opening means, a fan located in the duct means which when actuated will cause combustion gases to flow from the inlet end to the outlet end, and damper means in the duct means located downstream of the fan which can be closed to protect the fan from hot furnace combustion gases when it is not operating.

* * * * *